United States Patent [19]

Payant

[11] 3,999,251

[45] Dec. 28, 1976

[54] BUCKLE AND CLIP APPARATUS

[76] Inventor: Noel M. Payant, 325 W. 5th Ave., Shakopee, Minn. 55379

[22] Filed: July 1, 1976

[21] Appl. No.: 701,632

[52] U.S. Cl. ..... 24/7; 24/79; 24/188

[51] Int. Cl.[2] ..... A45F 5/04; A44B 11/24

[58] Field of Search ..... 24/7, 79, 3 L, 188

[56] References Cited

UNITED STATES PATENTS 2,471,783 5/1949 Schroeder ..... 24/7

FOREIGN PATENTS OR APPLICATIONS 357,045 11/1961 Switzerland ..... 24/188

*Primary Examiner*—Bernard A. Gelak

*Attorney, Agent, or Firm*—Paul L. Sjoquist

[57] ABSTRACT

An apparatus for attachment to a belt to serve as a conventional belt buckle, having the additional feature of a split construction wherein the two buckle halves are held together along an edge by a spring hinge so that the buckle may additionally serve as a clip for napkins and the like.

9 Claims, 4 Drawing Figures

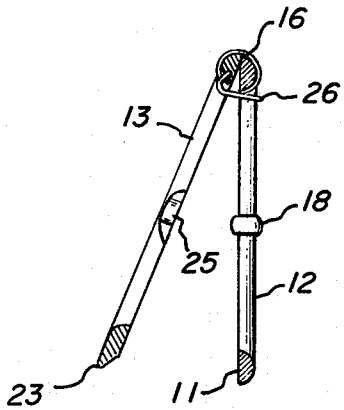
FIG. 4
FIG. 1
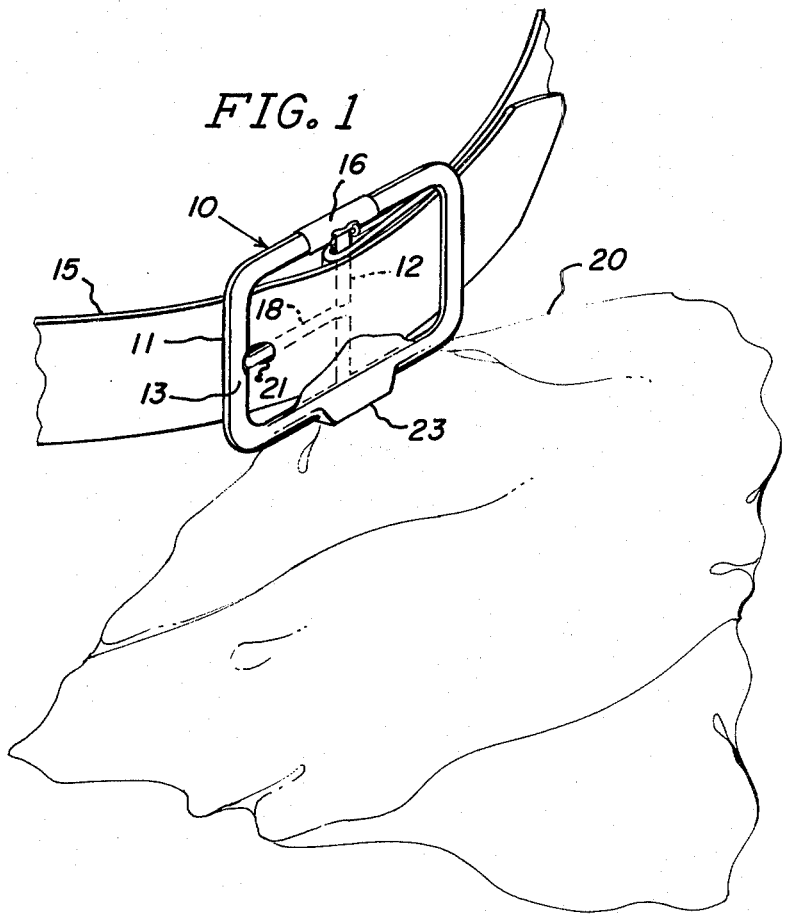
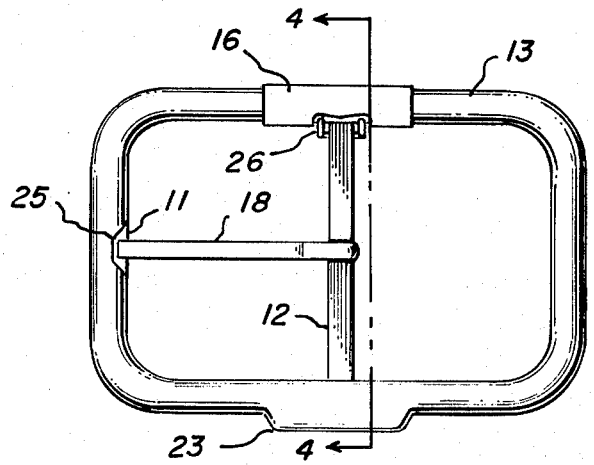
FIG. 2
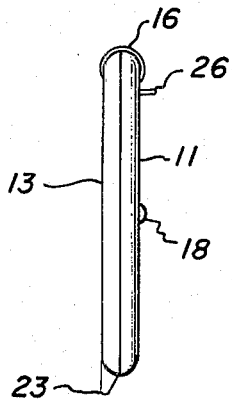
FIG. 3

BUCKLE AND CLIP APPARATUS

BACKGROUND OF THE INVENTION

This invention relates to a novel belt buckle construction which enables the buckle to function in its normal intended fashion and also to function as a clip. It is primarily intended for use in cooperation with a trouser belt, although the novel principles of the invention may be usable in any buckle application wherein it is desirable to have a clamping means associated with the buckle.

For a considerable number of years the construction of belt buckles has been standardized along several design options. In one form of design option the buckle consists of a closed loop metal frame, usually rectangular in shape, with a pivotal belt fastener attached around one leg. One end of a belt is attached, more or less permanently, around the same leg, and the other end of the belt has a number of spaced belt holes or perforations so that the belt length may be selectively adjusted and the belt fastener may be inserted through one of the perforations to hold the belt length at the selected distance. The belt fastener is made slightly longer that the metal loop width so that it is prevented from complete rotational freedom by contacting the opposite leg of the buckle frame.

A second fairly standardized form of belt buckle comprises a metal frame, usually rectangular in shape, having an intermediate center crossbar around which the belt fastener is pivotally attached. The length of the belt fastener is made slightly longer than the distance to an opposite buckle leg to prevent rotational freedom, and one end of the belt is fastened, more or less permanently, to the center crossbar member. In this belt buckle embodiment the fastener is attached in the conventional way, although the loop end of the belt is fed beneath the two buckle outside legs and above the center bar.

Any number of stylistic design approaches may be used with the two foregoing buckle constructions to provide an endless variety of buckle designs. The present invention relates primarily to the second buckle construction described above, and although only a single stylistic design is shown herein, it should be understood that the structural features of the invention are operable with an infinite variety of stylistic designs.

SUMMARY OF THE INVENTION

The present invention comprises a belt buckle having a closed loop construction, with an intermediate center bar for pivotally attaching a belt fastener. The buckle frame member is transversely split into two matched halves, although the intermediate bar is attached to only one of the halves. The two halves are held together by means of a spring hinge, which exerts a closing force while permitting the halves to be respectively separated without affecting the buckle's function of securing a belt.

BRIEF DESCRIPTION OF THE DRAWINGS

A preferred embodiment of the invention is described herein, and with reference to the drawings, in which:

FIG. 1 shows an isometric view of the invention in useful operation;

FIG. 2 is a top plan view;

FIG. 3 is a side elevational view; and

FIG. 4 is a side cross sectional view taken along the lines 4—4 of FIG. 2, and wherein the clip is partially opened.

DETAILED DESCRIPTION OF THE PREFERRED EMBODIMENT

Referring first to FIG. 1, a buckle 10 is shown attached to a belt 15 in the normal manner, and also clamped to a napkin 20. Buckle 10 is comprised of a pair of split buckle halves 11 and 13, a center bar 12, a spring hinge 16, and a belt fastener 18. One end of belt 15 is typically looped about center bar 12 and is more or less permanently attached thereto. The other end of belt 15 has a number of perforations, such as perforation 21, which are used to selectively adjust the length of the belt. A handle projection 23 is formed along one side of top half buckle portion 13, preferably opposite spring hinge 16.

FIG. 2 is a top plan view of the apparatus. Belt fastener 18 is typically attached around center bar 12, but has a length which prevents complete rotational movement by contacting belt fastener 18 against lower half buckle 11. Upper half buckle 13 has a notch 25 at the point of contact of belt fastener 18 so that belt fastener 18 does not engage against upper half buckle 13.

Spring hinge 16 has a wire clip 26 attached thereto, and clip 26 extends around center bar 12. The purpose of clip 26 is to position spring hinge 16 relative to center bar 12, and to limit the maximum opening distance which the two buckle halves may be separated.

FIG. 3 shows the apparatus in side elevational view, illustrating the adjacent mating structure of half buckle 11 and 13. Handle projection 23 is shown projecting outwardly from top half buckle 13.

FIG. 4 is a view taken along the lines 4—4 of FIG. 2, having the additional showing of the belt buckle clip partially opened. Spring clip 26, attached to spring hinge 16, prevents a full opening of top half buckle 13 from bottom half buckle 11. When top half buckle 13 is swung away from bottom half buckle 11, belt fastener 18 remains pressed against lower half buckle 11, because notch 25 provides clearance space for the free motion of top half buckle 13.

Detailed changes in several of the design parameters of this invention may be made within the spirit and scope of the invention. In particular, spring hinge 16 may be formed from other well known springing arrangements wherein a closing force is combined with a hinge action. For example, a torsion spring or leaf spring could be adapted for use with the present invention, and other forms of hinge restricting devices could be used in place of clip 26. Handle projection 23 could be placed along other sides of top handle projection 23, it being necessary only that a gripping surface be provided so that top half buckle 13 can be lifted against the force of spring hinge 16.

In operation, the buckle is attached to a belt in a conventional manner. Whenever it is desired to clip the buckle to a napkin or the like, handle projection 23 is grasped to lift top half buckle portion 13 away from lower half buckle 11. A napkin or the like is inserted between the two buckle halves, and handle projection 23 is released. Spring hinge 16 exerts a closure force to clamp the napkin or the like between the two half buckles, and the napkin is securely attached thereafter. To release the napkin, all that is necessary is for handle projection 23 to be moved slightly to release the gripping force of spring hinge 16. In this manner, the invention provides a novel and convenient apparatus for holding napkins while eating, and for any of a number of other activities requiring the combination of a belt buckle and spring clamp apparatus as disclosed herein.

What is claimed is:

1. In a belt buckle apparatus of the type having a closed frame member with an intermediate crossbar for pivotally attaching a belt fastener and for attaching a first belt end, the improvement comprising:

a. a second frame member positioned adjacent said closed frame member; and b. a spring hinge member located along and joined to respective sides of said closed frame member and said second frame member, and exerting a closing force tending to hold said second frame member against said closed frame member.

2. The apparatus of claim 1, wherein said second frame member further comprises means for grasping.

3. The apparatus of claim 2, wherein said second frame member is identical in size to said closed frame member and said second frame member has a notched edge to provide clearance for said belt fastener.

4. The apparatus of claim 3, wherein said spring hinge member further comprises means for limiting the maximum hinge opening distance.

5. The apparatus of claim 4, wherein said spring hinge member further comprises means for locating member relative to said intermediate crossbar.

6. A belt buckle and clamping apparatus, comprising:

a. a first closed frame member having an intermediate crossbar and having a belt fastener pivotally attached proximate the center of said crossbar;

b. a second closed frame member positioned adjacent said first frame member;

c. a hinge and spring clamping means attached to said first and second frame members for exerting a closing force tending to hold said first and second frame members in adjacent alignment; and d. a projection extending from said second frame member, for grasping to open said respective frame members against the force of said spring clamping means.

7. The apparatus of claim 6, wherein said second frame member further comprises a notched edge for clearance past said belt fastener.

8. The apparatus of claim 7, wherein said hinge and spring clamping means further comprises a C-clamp impinging about said first and second frame members.

9. The apparatus of claim 8, wherein said C-clamp further comprises means for centering about said intermediate crossbar.

* * * * *